United States Patent [19]

Snow, Jr. et al.

[11] 4,288,961

[45] Sep. 15, 1981

[54] RIGID STEEL BRACE FOR OFFSET TRUSSES

[76] Inventors: Kenneth T. Snow, Jr., 837 Prince Charles La., Schaumburg, Ill. 60195; Robert N. Snow, 1631 Mulberry Ct., Elgin, Ill. 60120

[21] Appl. No.: 132,833

[22] Filed: Mar. 24, 1980

[51] Int. Cl.[3] ..... E04B 7/08

[52] U.S. Cl. ..... 52/738; 52/90; 52/639

[58] Field of Search ..... 411/459, 460, 463, 464, 411/462; 52/90, 92, 93, 642, 639, 695, 696, 697, 738, 739

[56] References Cited

U.S. PATENT DOCUMENTS

| | | | |
|---|---|---|---|
| 793,353 | 6/1905 | Cook | 52/697 |
| 811,003 | 1/1906 | Tudor | 52/738 |
| 1,106,844 | 8/1914 | Ream | 52/695 |
| 1,230,305 | 6/1917 | Klay | 52/90 |
| 1,746,344 | 2/1930 | Pürr | 52/695 |
| 1,983,612 | 12/1934 | Junkers | 52/738 |
| 2,464,080 | 3/1949 | Hankins | 52/146 |

FOREIGN PATENT DOCUMENTS 512065 11/1930 Fed. Rep. of Germany .

*Primary Examiner*—Price C. Faw, Jr.
*Assistant Examiner*—Henry E. Raduazo
*Attorney, Agent, or Firm*—Kenneth T. Snow

[57] ABSTRACT

A steel brace for reinforcing an offset truss intermediate its heel joint and its ridge board. The steel brace has one end thereof nailed into the ceiling joist on one side and has its other end nailed into the roof rafter on the other side. The brace is provided with a deep rib extending longitudinally from one end to a position beyond the center of the brace and a laterally spaced apart deep rib extending longitudinally from the other end to a position beyond the center of the brace in the opposite direction. One of the deep ribs being convexly formed in said steel brace and the other spaced apart deep rib being concavely formed therein. The ribbed steel brace is thus provided with oppositely disposed flat surfaces at the ends thereof to abut the oppositely disposed ceiling joist and roof rafter for nailing thereto.

1 Claim, 6 Drawing Figures

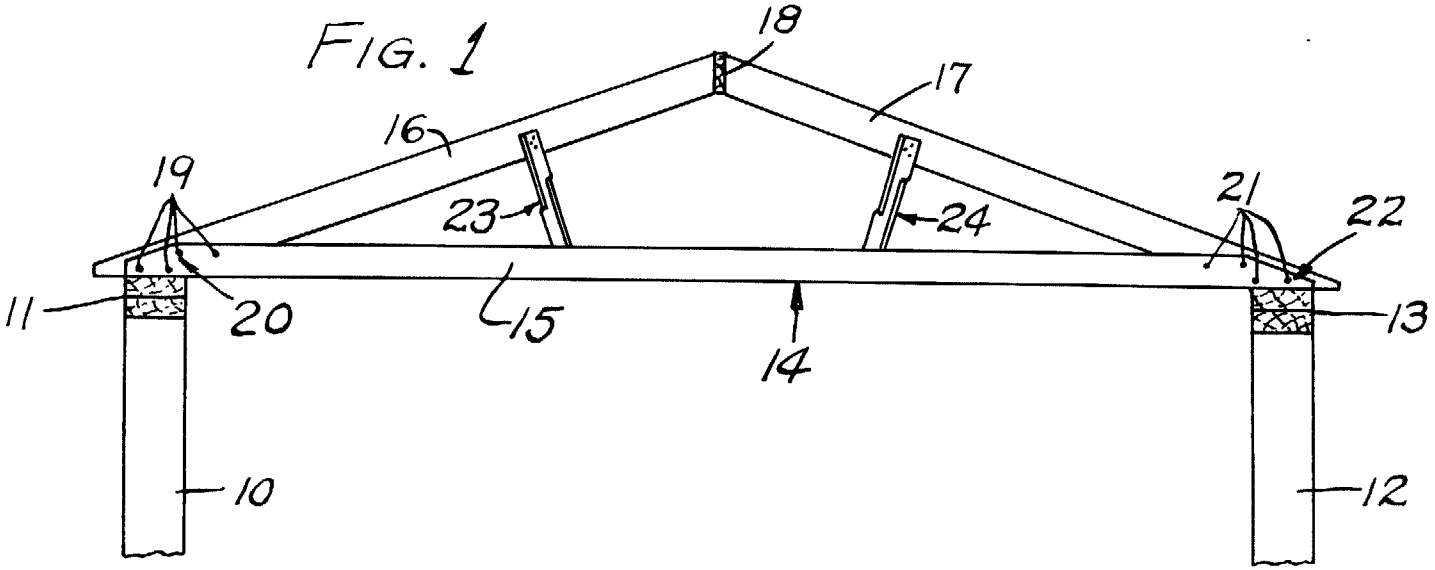
FIG. 1
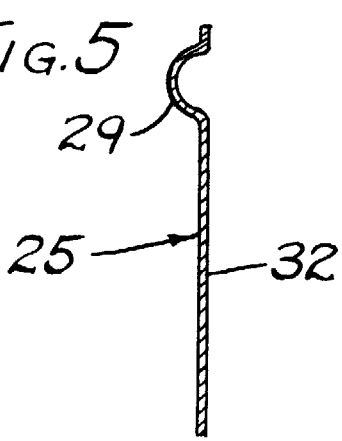
FIG. 3
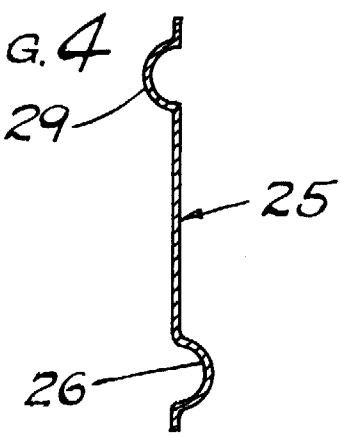
FIG. 4
FIG. 5

RIGID STEEL BRACE FOR OFFSET TRUSSES

BACKGROUND OF THE INVENTION

1. Field of the Invention

The brace of the present invention reinforces the structural members of an offset truss used to span spaced apart building walls. An offset truss is one where the structural components of the truss are not in a single plane and is defined as one made by nailing the roof rafter against the side of a ceiling or cross tie joist at the position where the joist rests on the top plate of a building wall.

In the past a lumber plank of generally 1" nominal thickness by 5" or 6" wide has been used to brace these diverging joists and rafters. The wooden plank brace would be disposed intermediate the heel joint of the truss and the ridge board of the building roof. Because of the offset arrangement of the joist and rafter the wood plank had to flex the amount of its thickness—usually in a span of 30" or less. This flexing necessity required the use of quality lumber or the plank would crack at the time of flexing. Obtaining consistently quality lumber is becoming more difficult and when it is obtained the price is very high. The use of metal substitutes for wood has existed for many years. Steel in particular, because of its strength has been used in building structures. Some have used steel entirely and others have used a combination of steel and wood. The present invention concerns the use of a steel brace for basically wood frame members. Because of the thinness of the steel used the problem of flexing is eliminated. It is a requirement that the steel brace which replaces the wood plank be as strong in every respect as the wood it replaces. The inherent tensile strength of the steel easily matches the tensile strength of the wood and with the steel brace ribbed as set forth in this invention it fully matches the strength of the wood in its compression loading. It is the particular ribbing arrangement throughout the length of the steel braces in combination with the provision for flat nailing surfaces at each opposite end of the braces that comprise applicant's inventive concept.

2. Description of the Prior Art

A search has disclosed the following prior patents which appear to have pertinence relative to the present invention.

U.S. Pat. No.—Tudor 811,003—Jan. 30, 1906

British Pat. No.—Junkers 340,412—Jan. 1, 1931

British Pat. No.—Gibbs 534,267—Mar. 3, 1941

The 1906 Tudor United States patent shows a metal brace having a longitudinal rib throughout its major extent, but leaving plain flat marginal ends to enable the brace to flatly abut a surface in use.

The 1931 British patent to Junkers describes a bar or brace fabricated from sheet metal. It is reinforced to withstand buckling from compression loads by bent side flanges as well as ribs impressed in the brace adjacent its flat ends. This British patent recognizes the culpability of the brace to buckling when subjected to compression loads. On page 1, lines 41 to 46 of the Junkers patent, the specification read as follows:

> "As regards the buckling stresses it has been found that rods of this kind when subjected to compression in a network yield first of all at the point where the web portion converges into the flat end portion."

And, on page 1, lines 53 to 66 this British patent reads as follows:

> "According to the invention, the desired increase in resistance to buckling is obtained by providing the web, which is otherwise flat, with auxiliary embossments, corrugations or other shapes having a stiffening effect, in the vicinity of the ends of the bar only, such additional stiffening shapes extending approximately in the axial direction of the bar as far as the boundary between the web and the end portion, but not into the latter, so that, as in the embodiments already known, the whole of the end portion of the bar can remain flat."

In this British patent to Junkers it is evident the ribs and flanges stop short of the ends of the brace to permit its attachment in application. It is probably true that the closeness of the special stiffening ribs to the flat ends will likely minimize buckling under compression. However, buckling is not eliminated because the ribs do not extend into and through the attaching end portions.

The 1941 British patent to Gibbs discloses bracing formed with side flanges and ribs for strengthening. On page 1, lines 86 to 96 of the Gibbs patent, the specification states:

> "In order to strengthen the vertical and diagonal members these latter are provided with channels 6 (see FIG. 3), which are formed by indenting the metal by a rolling or pressing operation. Such channels 6 give rigidity to a strip which would otherwise be flexible, and extend almost to the ends of the members 5 and 6, leaving a short portion flat where these members are attached to the sides of the top and bottom members 1 and 2."

Here again the ribs are shortened to leave flat ends for attaching the brace in use and it is vulnerable to buckling at those flat end portions.

In contrast to the known prior art applicant's brace is ribbed all the way to the ends and yet provides flat attaching ends on opposite sides for application to offset trusses.

SUMMARY OF THE INVENTION

A principal object of the present invention is to provide a novel generally narrow elongated steel brace for reinforcing offset trusses and having ribs formed therein which effectively extend from one end throughout to the other end and yet leaving flat ends for the attachment of the brace in use.

An important object of this invention is to provide a novel steel brace for reinforcing offset trusses substantially uniformly upon the imposition of extension or compression loads thereon.

Another important object of this invention is to provide a novel relatively narrow galvanized steel brace having a relatively deep concave rib formed therein in a longitudinal direction and extending from one outer end of the brace to a position beyond the center of the brace, and having a relatively deep laterally spaced apart convex rib formed therein in a longitudinal direction and extending from the other outer end of the brace to a position beyond the center of the brace to thereby resist buckling upon the application of compression loads thereon.

A still further important object of this invention is to provide the novel brace of the preceding object in which the ends of the brace have flat attaching ends on opposite sides thereof.

Other and further important objects and advantages will become apparent from the disclosures in the following specification and accompanying drawings.

IN THE DRAWINGS

FIG. 1 is a cross section taken through the upper portion of a wood frame building having offset trusses and employing the steel braces of this invention.

FIG. 3 is an enlarged sectional view taken on the line 3—3 of FIG. 2.

FIG. 4 is an enlarged sectional view taken on the line 4—4 of FIG. 2.

FIG. 5 is an enlarged sectional view taken on the line 5—5 of FIG. 2.

AS SHOWN IN THE DRAWINGS

Figure 6:
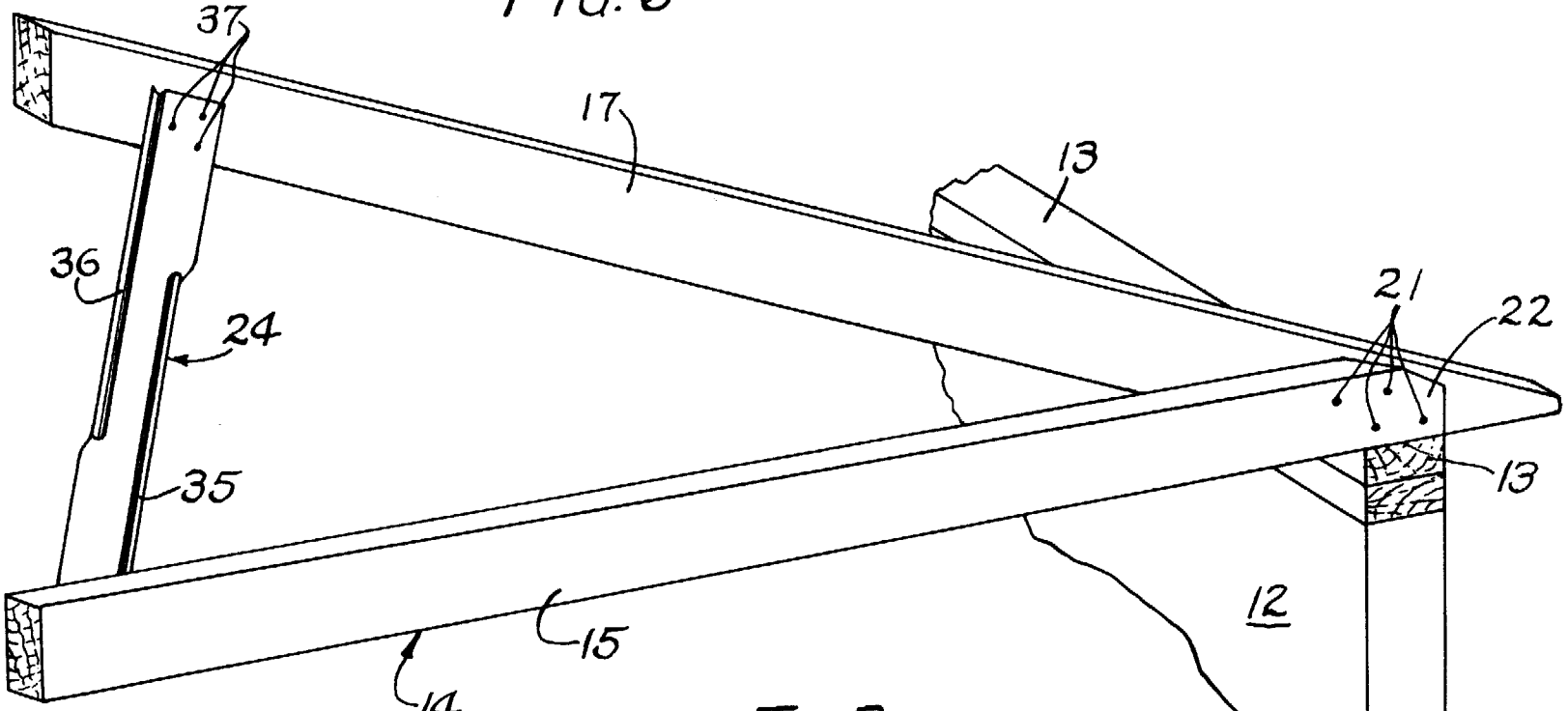
FIG. 6 is an enlarged perspective view of a portion of an offset truss of FIG. 1 and showing the steel brace of this invention assembled thereon.

The reference numeral 10 indicates generally a building wall in a building of the type known as wood frame. In the present showing the wall 10 is equipped with a double top plate 11. The building has a spaced apart wall 12 which also is equipped with a double top plate 13. These walls 10 and 12 are known as load bearing walls and act to directly support and carry the roof of the building.

In the construction of a roof, a truss member is used to span the spaced apart walls. At the present time there are a variety of types of trusses that may be used, and including different materials. Wood has been the predominant material but metals, such as steel are also used. Many of the mass produced buildings employ factory made wooden trusses which are built in a single plane—that is all of the component members of the truss are disposed in a flat plane. However, many builders still construct their own trusses on the job site and in those instances they generally build what are described as offset trusses. An offset truss does not have its component members lying in a single plane, but rather the components are nailed in a side-by-side relationship and thus are offset. It is this offset truss that is to be reinforced by the brace of the present invention.

An offset truss 14 is shown generally in FIG. 1 as spanning the space between the building walls 10 and 12. The truss includes a cross tie joist 15 which has its ends resting directly on the top wall plates 11 and 13. This joist ties the walls together and in most instances where the building is finished in the interior it acts as the ceiling joist to which a ceiling may be attached. The truss 14 further includes a first roof rafter 16 which has its lower outer end disposed on the top plate 11 in side abutting relationship with the cross tie joist. Usually a short portion of the rafter is permitted to extend outwardly of the wall 10 and later forms, with other such truss extensions, the eaves of the building. The inwardly extending portion of the roof rafter 16 angles upwardly in divergence to the cross tie 15 and in a direction toward the spaced apart wall 12. A second roof rafter 17 has one end disposed on the other top plate 13 and from there angles upwardly and toward the first wall 10. At approximately the midway distance between the building walls 10 and 12 the roof rafters 16 and 17 are joined by a ridge board 18. The ridge board constitutes the apex of the roof formed by several such offset trusses. Each roof rafter is attached to the ridge board, usually by nailing. The offset truss 14 thus comprises the cross tie joist 15, the roof rafters 16 and 17, and the included ridge board 18. Nails 19 are driven through the cross tie joist into the side of the lower outer end of the roof rafter 16 and that juncture of cross tie and rafter comprise one heel joint 20 of the offset truss 14. Similarly nails 21 are driven through the cross tie 15 into the side of the lower outer end of the other roof rafter 17 and together these attached members 15 and 17 constitute a second heel joint 22 of the offset truss 14.

It is common practice for builders to reinforce such offset building trusses with braces intermediate the heel joints and the ridge board. In the past this bracing generally utilized a wooden plank having its one end nailed into one side of the roof rafter and then by flexing that wood plank the degree of its thickness, the other side at the other end would be nailed into the cross tie. Depending upon the pitch of the roof being made, these braces would vary in length. However, braces in the order of 30" long have been common. To flex a wooden plank, usually of 1" nominal thickness and perhaps 5 or 6" wide, the amount of its thickness in just 30" of length required the use of quality wood. Such wood and its cost has discouraged builders and it is to that end that the brace of the present invention has been invented and developed.

A steel brace 23 is shown disposed between the roof rafter 16 and the cross tie joist 15 in FIG. 1. Similarly another such steel brace 24 is disposed between the roof rafter 17 and the cross tie joist 15. These steel braces 23 and 24 become part of the offset truss 14 and act to reinforce the roof rafters 16 and 17 in both compression from roof loads, such as snow, and in extension against the upward forces of wind storms. The braces 23 and 24 are preferably made of narrow, relatively thin galvanized sheet steel strips. Although this invention and the patent therefor is not concerned with actual dimensions it is believed desirable to identify dimensions for the brace which have proven to be successful and fulfill the strength requirements of tests made on such braces. The width should be in the order of 2" to 4½", the length in the order of 20" to 40" and the thickness in the order of 20 gauge to 14 gauge. The prototype brace constructed according to this invention has physical dimensions of 3½" wide × 26" long × 18 gauge thick. The braces 23 and 24 have been shown in the building of FIG. 1 to identify the environment of the braces in an offset truss. The details of the brace construction are shown in FIGS. 2 to 5 on a relatively larger scale and have been given new reference numerals to avoid confusion.

Figure 2:
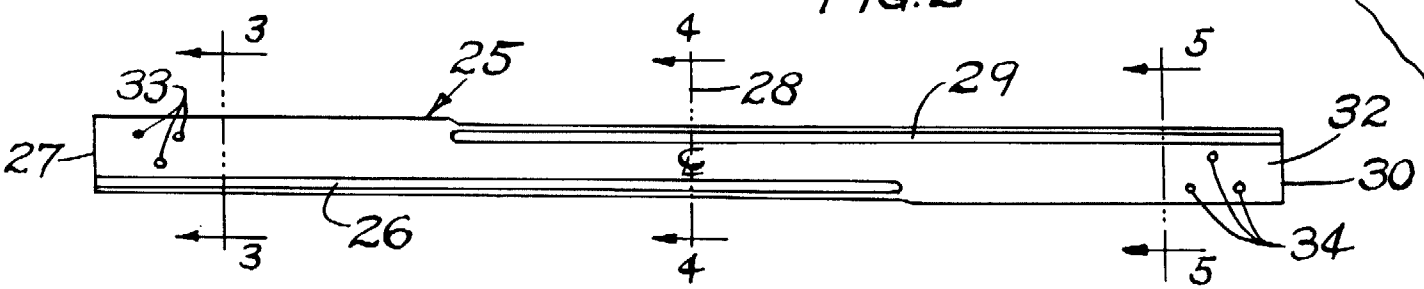
FIG. 2 is an elevational view of the rigid steel brace of this invention.

Reference numeral 25 identifies generally the steel brace of this invention as shown in FIG. 2. As stated, the brace includes an elongated strip of galvanized sheet steel of narrow width and relatively thin, but having substantial strength in extension. It is the ribbing which will now be described that gives the brace its resistance to great compression loads so that overall the brace has strengths substantially equal in both extension and compression. As explained above the brace for an offset truss requires that the ends thereof be flat on opposite sides because it is to be attached to one side of a roof rafter and to the other side of the cross tie joist. Testing of all braces presently available which have flat, unribbed ends, shows that they fail under the application of compression loads at the juncture between the end attaching flats and the ribbing which has always been located at a position spaced from the flat ends. In the present invention a deep convex rib 26 is formed in the brace 25 and extends continuously from the first end 27 of the brace in a longitudinal direction to a position beyond the centerline 28 of the brace. A sectional view of the brace taken on the line 3—3 is shown in FIG. 3 and depicts the deformation of the steel strip in the deep rib 26. A sectional view of the brace taken on the line 4—4, which is coincident with the brace centerline 28, is shown in FIG. 4 and again depicts the presence of the convex rib 26. A deep concave longitudinal rib 29 is formed in the brace 25 and is disposed in laterally spaced apart position relative to the convex rib 26 and is generally parallel thereto. The longitudinal concave rib 29 extends continuously from the second outer end 30 of the brace 25 to a position beyond the centerline 28 of the elongated brace in a direction opposite to the rib 26. Because the ribs extend beyond the centerline 28 of the brace in opposite directions there is a substantial overlap of those ribs in the area of the center of the brace. This provides the brace with an effective ribbing of the brace throughout its entire length from one outer end 27 to the other end 30. These parallel spaced apart ribs 26 and 29 have a resultant compression strength substantially equal to that of a brace which has uninterrupted ribbing from one end to the other end. Straight through ribbing is not possible for the offset truss reinforcement because it is necessary to have flat attaching surfaces on opposite sides of opposite ends of the reinforcing brace. Thus, the combination of convex and concave parallel spaced apart ribbing permits uninterrupted ribbing from one end of the brace to the full other end of the brace and simultaneously provides for the opposite attaching surfaces at the ends thereof where the one end can flushingly abut one side of a roof rafter and the other end can flushingly abut the other side of a cross tie joist. Flexing of the brace the degree of its thickness is not a problem as it is in a wood plank brace because of its relative thinness. There is no noticeable flexing of a steel brace in the order of 0.050" thick by 30" long. The sectional view taken on the line 5—5 of FIG. 5 shows the concave rib 29 formed in the brace at its end opposite the existence of the convex rib 26. FIG. 4 taken through the center of the brace shows the existence of both convex and concave ribs.

The end 27 of the brace 25 is provided with a flat surface 31 as shown in FIG. 3. At this end the flat surface 31 is on the underside of the brace as it is viewed in FIG. 2 because the rib 26 coming to that end is convex and causes the steel to be deformed away from that flat underside. The other end 30 of the brace 25 is provided with a corresponding flat surface 32 which is on the top side of the brace as viewed in FIG. 2. As shown in FIG. 5 the concave rib 29 is distended away from the flat surface 32. The flat surfaces 31 and 32 are thus located on opposite sides of the brace and at opposite ends of the brace.

Nail holes 33 are provided in the flat surface 31 and similar nail holes 34 are provided in the flat surface 32. The flat surfaces are arranged to abut opposite sides of a roof rafter and the cross tie joist. It is immaterial which end of the brace is up or down in its generally vertically disposed position in use. The brace works equally well in either position.

In an attempt to more clearly show the application of the steel brace of this invention, the enlarged perspective view of FIG. 6 is included with the drawings. This view shows a portion of the building shown in FIG. 1. This portion includes the building wall 12, the cross tie joist 15 and the roof rafter 17. FIG. 6 shows the offset truss 14 with the steel brace of this invention identified by the numeral 24. The concave rib in the brace 24 is identified by the numeral 35 and the convex rib by the numeral 36. The flat surface of this brace is thus on the underside at the top adjacent the roof rafter 17. Nails 37 are driven through the holes provided in that end and securely hold the brace at its top to the front side of the roof rafter 17. The flat surface at the other bottom end of the brace is located on the front side of the brace behind the cross tie joist 15 and is nailed into the back side of that joist 15. By test, the brace identified by any of the numerals 23, 24 and 25 in its different showings is stronger in compression and extension than the nails used to attach the brace in its application to the offset truss. There is thus provided ideal maximum bracing for an offset truss with the rigid steel brace constructed as described herein.

We are aware that numerous details of construction may be varied throughout a wide range without departing from the principles disclosed herein and we therefore do not propose limiting the patent granted hereon otherwise than as necessitated by the appended claims.

What is claimed is:

1. A brace for reinforcing an offset truss at a location spaced intermediate the heel joint of cross tie joist and roof rafter and a centrally disposed ridge board at the top center of the truss, comprising, a generally narrow elongated steel strip, said strip formed with a deep concave rib running longitudinally thereof and extending from a first end to a location beyond the center of the strip but stopping short of the other second end of said strip, said strip further formed with a deep convex rib disposed generally parallel to and spaced laterally from said concave rib and extending from the second end to a location beyond the center of the strip but stopping short of the first end of the strip, the first end of said strip having a flat surface on the top side thereof and the second end of said strip having a flat surface on the other under side thereof, means attaching the flat surface on one side of the strip at one end to the side of the roof rafter and means attaching the flat surface on the other side of the strip at the other end to the side of the cross tie joist.

* * * * *